United States Patent [19]

Nishino et al.

[11] Patent Number: 5,045,157

[45] Date of Patent: Sep. 3, 1991

[54] PROCESS FOR PRODUCING ALUMINUM SUPPORT FOR PRINTING-PLATE

[75] Inventors: Atsuo Nishino; Tsutomu Kakei, both of Shizuoka, Japan

[73] Assignee: Fuji Photo Film Co., Ltd., Kanagawa, Japan

[21] Appl. No.: 330,834

[22] Filed: Mar. 30, 1989

[30] Foreign Application Priority Data

Mar. 31, 1988 [JP] Japan ..... 63-76401

[51] Int. Cl.[5] ..... C25F 3/04; C25D 5/44

[52] U.S. Cl. ..... 204/33; 204/129.35; 204/129.4; 204/129.75; 204/DIG. 9

[58] Field of Search ..... 204/DIG. 9, 129.4, 129.75, 204/129.35, 33

[56] References Cited

U.S. PATENT DOCUMENTS

| | | | |
|---|---|---|---|
| 4,272,342 | 6/1981 | Oda et al. | 204/129.4 |
| 4,294,672 | 10/1981 | Ohba et al. | 204/129.4 |
| 4,476,006 | 10/1984 | Ohba et al. | 204/129.4 X |
| 4,482,434 | 11/1984 | Pliefke | 204/DIG. 9 |
| 4,548,683 | 10/1985 | Huang et al. | 204/DIG. 9 X |
| 4,561,944 | 12/1985 | Sasaki et al. | 204/33 |
| 4,576,686 | 3/1986 | Hirokazu et al. | 204/33 |
| 4,686,021 | 8/1987 | Nakanishi et al. | 204/DIG. 9 |
| 4,741,812 | 5/1988 | Kojima | 204/DIG. 9 X |

FOREIGN PATENT DOCUMENTS

| | | |
|---|---|---|
| 53-67507 | 6/1978 | Japan . |
| 54-65607 | 5/1979 | Japan . |
| 55-25381 | 2/1980 | Japan . |
| 56-29699 | 3/1981 | Japan . |

*Primary Examiner*—Donald R. Valentine

*Attorney, Agent, or Firm*—Sughrue, Mion, Zinn, Macpeak & Seas

[57] ABSTRACT

A process for producing support for aluminum printing-plate in which an aluminum support is electrochemically surface-roughed uses an alternating current in an acid electrolyte containing nitric acid. The alternating current has a waveform in which the frequency is within a range of 60 to 140 Hz and the ratio of an anode time $t_F$ to a period T, that is, $t_F/T$, is within a range of 0.33 to 0.15, and this current is used as an electrolytic power source.

12 Claims, 1 Drawing Sheet

PROCESS FOR PRODUCING ALUMINUM SUPPORT FOR PRINTING-PLATE

BACKGROUND OF THE INVENTION

The present invention relates to a process for producing aluminum support for printing-plate, and particularly relates to a process for producing a printing-plate support constituted by a surface-roughed aluminum plate suitable for an offset printing plate.

It has been proposed to use an aluminum plate (including an aluminum-alloy plate) as a printing-plate support and particularly as a support for an offset printing plate.

Generally, in order to use an aluminum plate as a support for offset printing, it is necessary that the aluminum plate have a suitable adhesion to a photosensitive material and suitable water-retention.

To this end, it is necessary to surface-rough the aluminum plate to achieve a uniformly and finely grained surface. This surface-roughing treatment largely affects the performance and durability of a plate material when offset printing is performed using such a plate. Therefore, the quality of the surface-roughing treatment has been an important factor in producing a plate material.

An AC electrolytic etching method has been used generally for surface-roughing an aluminum printing-plate support. This etching method uses a sinusoidal-wave AC current or a special alternating waveform current such as a square wave. By use of a proper electrode (such as graphite) as an opposite electrode, the surface-roughing treatment is performed on an aluminum plate with an AC current. The treatment is usually performed once, and, generally, the depth of the thus obtained pits has been so shallow that the plate is poor in durability against printing. Various methods have been therefore proposed to obtain an aluminum plate suitable as a printing-plate support having a grained surface where pits sufficiently deep relative to their diameter are uniformly and finely formed. The proposed methods include the following: a surface-roughing method using a special electrolytic power source waveform (see Japanese Patent Unexamined Publication No. 53-67507); a ratio between quantities of electricity in an anode time and in a cathode time in electrolytic surface-roughing by using an alternating current (see Japanese Patent Unexamined Publication No. 54-65607); a power source waveform (see Japanese Patent Unexamined Publication No. 55-25381); a combination of quantities of current conduction per unit area (see Japanese Patent Unexamined Publication No. 56-29699), and so on.

In performing electrochemical surface-roughing on an aluminum-alloy plate represented by a JIS 3003 material, the pits obtained by the above-mentioned methods lack sufficient depth and uniformity and have a complicated uneven shape. Moreover, even if an offset printing plate is formed using such an aluminum-alloy plate, the printing plate is insufficient in printing performance and durability and it has been difficult to obtain a satisfactory printing plate. To solve this problem, an electrochemical surface-roughing using an alternating current of a low frequency within a range of 1.5 to 10 Hz has been disclosed in U.S. Pat. No. 4,482,434. However, where an aluminum plate is subjected to continuous electrochemical surface-roughing by using such a low frequency alternating current, the thus formed printing plate has a defect that in treatment, unevenness in the form of a transverse stripe pattern occurs perpendicularly to the advancing direction of the aluminum plate. Moreover, when a low frequency alternating current is used, carbon conventionally used for electrochemical surface-roughing quickly dissolves and it has been difficult to use this surface-roughing method in industrial practice.

SUMMARY OF THE INVENTION

It is an object of the present invention to solve the foregoing problems, and to provide a process for producing an aluminum support for printing-plate constituted by an aluminum plate which has satisfactory printing performance and durability without producing stripe-patterned unevenness yet achieving a grained surface where pits which are deep relative to their diameter are uniformly and finely formed.

The foregoing and other objects of the present invention are attained by a process for producing support for printing-plate in which an aluminum support is electrochemically surface-roughed by using an alternating current in an acid electrolyte containing nitric acid, characterized in that an alternating current having a waveform in which the frequency is within a range of 60 to 140 Hz and the ratio of an anode time $t_f$ to a period T, that is, $t_f/T$, is within a range of 0.33 to 0.15, is used as an electrolytic power source.

DETAILED DESCRIPTION OF THE PREFERRED EMBODIMENT(S)

Figure 1:
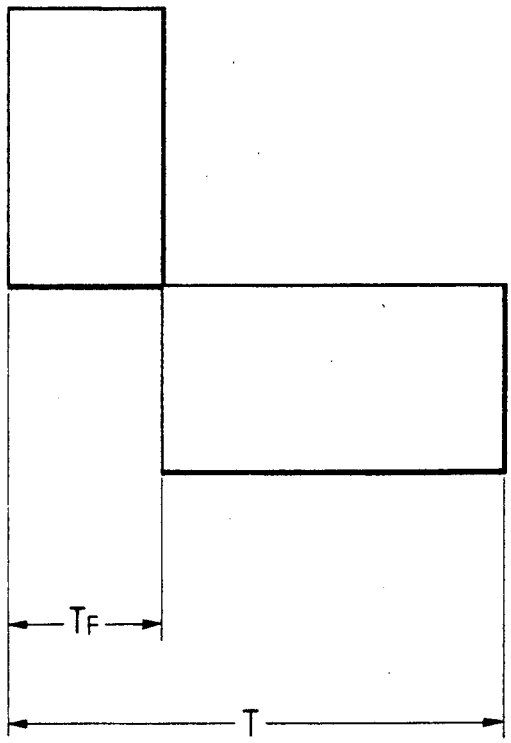
FIG. 1 is a diagram illustrating an example of a power source waveform according to the present invention.

The present invention is a process for producing an aluminum support for a printing-plate. In the process, a pure aluminum or aluminum-alloy plate is subjected to electrochemical surface-roughing using an alternating current in an acid electrolyte containing nitric acid. The alternating current, used as an electrolytic power source, has a waveform in which the frequency is from 60 to 140 Hz and the ratio of anode time $t_f$ to a period T ($t_f/T$) is from 0.33 to 0.15.

The aluminum support according to the present invention may thus be a pure aluminum plate or an alloy plate containing aluminum as its principal component, for example, a JIS 1050 material, a JIS 1100 material, JIS 3003 material, JIS 3103 material, an alloy plate containing Mn by not less than 0.3 wt%, etc. The effect is remarkable when an alloy plate containing aluminum as its main component is used. A specific example of such an alloy plate containing aluminum as its principal component is an aluminum plate containing at least 0.3 wt% of Mn, for example, a JIS 3003 material or a JIS 3103 material.

As the acid electrolyte containing a nitric acid, the following solutions may be used: an aqueous solution containing a nitric or hydrochloric acid as a main part; a solution having a mixture of a nitric acid and a hydrochloric acid; and an aqueous solution in which a phosphoric acid, a sulfuric acid, a nitric acid, a fluoric acid, an organic acid, etc. are mixed with a nitric or hydrochloric acid. According to the present invention, however, it is preferable to use an aqueous solution containing a nitric acid as a main component.

It goes without saying that the process of performing electrochemical surface-roughing by using an alternating current according to the present invention may be used in combination with any well-known electrochemical surface-roughing treatment, such as a combination with an electrolytic cell different in frequency from the current, a treatment of surface-roughing to which a desmutting treatment is inserted, a method in which electrochemical surface-roughing is performed with divided treatment cells, and so on.

The electrolytic power source waveform in the inventive method preferably has a frequency within a range of 60 to 140 Hz, and particularly 80 to 120 Hz and has a duty factor, i.e., a ratio of an anode time $t_F$ and a period T ($t_F/T$) of 0.33 to 0.15, and particularly 0.25 to 0.2.

Prior to performing the electrochemical surface-roughing according to the present invention, an aluminum support may be subjected to the following well-known procedures. That is, a pretreatment may be conducted. For example, the aluminum support may be immersed into a caustic soda aqueous solution to perform alkali etching for eliminating an external stain or a natural oxide coating, then immersed into a nitric or sulfuric acid aqueous solution to perform neutralization and desmutting. The treatment may be, for example, cleaning in which the surface of the aluminum support is cleaned through electrolytic grinding by immersion in an electrolyte containing a sulfuric or phosphoric acid as a main part, and so on. These and other treatments may be selectively performed as occasion demands. However, generally these treatments need not be performed.

The alternating current waveform used for electrochemical surface-roughing according to the present invention is a waveform of a current obtained by alternating the positive and negative polarities, such as a square wave, a trapezoidal wave, a sine wave, a triangular wave, or the like. Of these waveforms, a square wave is preferable, although the present invention is not limited to it.

As an electrolytic bath, while it is possible to use any usual type of bath using an alternating current for electrochemical surface-roughing, it is preferable to use an aqueous solution containing a nitric acid in an amount of 5 to 25 g/l (grams per liter) and having a temperature of 20° to 60° C. Further, it is preferable to select the average current density to be from 10 A/dm$^2$ to 50 A/dm$^2$. It is particularly preferable to select the density of nitric acid within a range of 7.5 to 12.5 g/l, and it is optimal to keep the temperature of the solution within a range of 35° to 45° C. It is also particularly preferable to use an average current density within a range of 15 to 30 A/dm$^2$.

According to the present invention, the term "average current density" is defined as a quotient obtained as follows. If a power source waveform has a period T, and a quantity of electricity has a value of $Q_F$ (or $Q_R$) when an aluminum plate is in an anode (or cathode) time during the period T, and the area of the plate that is subjected to treatment is represented by A, the "average current density," is defined as: $(Q_F/T)/A$ or $(Q_R/T)/A$.

An optimum roughed-surface cannot be obtained if electrolytic treatment time is too long or too short, and it is preferable to select the time to be within a range of 10 to 120 seconds.

It is possible to perform electrochemical surface-roughing according to the present invention through a batch process, a semicontinuous process, or a continuous process.

The electrochemically surface-roughed aluminum support obtained by the above-described method may be immersed in an aqueous solution containing an acid or an alkali to eliminate any smut composed of aluminum hydroxide (a by-product of the electrochemical surface-roughing treatment) and to perform slight etching, thereby achieving a far superior aluminum printing-plate support. The slight etching may be carried out using an electrolytic grinding treatment performed in a phosphoric or sulfuric acid electrolyte.

The thus obtained surface-roughed plate is subjected to an anodic oxidation treatment in an electrolyte containing a sulfuric or phosphoric acid in a general way so that a printing-plate support superior in hydrophilic property, water-retention and durability against wear from printing use is achieved. After the anodic oxidation treatment, the aluminum support may be immersed in an aqueous solution containing sodium silicate or the like as a hydrophilic treatment.

EXAMPLES

Although the present invention will be described hereunder specifically with reference to the following examples, the present invention is not limited to these specific examples.

A JIS 3003-H14 rolled aluminum plate was immersed in a 1% caustic soda aqueous solution at 25° C. for five seconds to perform degreasing and cleaning treatments, and thereafter rinsed. The aluminum plate was then immersed in an aqueous solution containing a nitric acid by 1% for ten seconds, then rinsed again. The plate was then subjected to an electrochemical surface-roughing treatment for twenty seconds in an aqueous solution containing a nitric acid in an amount of 10 g/l and kept at 45° C. by applying an alternating current across the aluminum plate and an electrode facing the plate. The alternating current had an average current density of 25 A/dm$^2$ when the plate was in a cathode time, with a duty factor and a frequency which were set to various values as shown in the Table 1.

Next, the plate was rinsed again, then immersed in an aqueous solution containing a sulfuric acid in an amount of 300 g/l at 60° C. for thirty seconds to remove any smut (composed primarily of aluminum hydroxide). The aluminum plate was thereafter rinsed.

The thus obtained aluminum plate was subjected to an anodic oxidation treatment in an aqueous solution containing a sulfuric acid in an amount of 100 g/l at 35° C. so that the quantity of oxide coating became 2.0 g/m$^2$.

Table 1 shows the results of the evaluation. The classification into quality grades (surface topography with respect to uniformity, absence estimation under a microscope), quality grade "A" is superior, "B" is good, "C" is passable.

TABLE 1

| Duty factor | f | | | | | |
|---|---|---|---|---|---|---|
| | 20 | 40 | 60 | 80 | 100 | 120 |
| 0.5 | C | B | B | C | C | C |
| 0.33 | C | C | A | A | A | C |
| 0.25 | C | C | B | A | A | A |
| 0.2 | C | C | B | A | A | — |

Key for Table 1 f = Frequency of the electrolytic power source

Quality grades
A:superior
B:good
C:passable
Duty factor $= t_F/T$

The inventive method of producing an aluminum printing-plate support in which an aluminum support is electrochemically surface-roughed by using an alternating current in an acid electrolyte containing a nitric acid, uses an alternating current having a waveform in which the frequency is within a range of 60 to 140 Hz and the duty factor is within a range of 0.33 to 0.15 as an electrolytic power source. It has thus become possible to produce an aluminum printing-plate support which has a grained surface where pits that are deep relative to their diameter are uniformly and finely formed and which has superior printing performance and durability without producing stripe-patterned unevenness in offset printing and so on.

What is claimed is:

1. A process for producing a support for an aluminum printing plate having a surface with pits formed therein, the process comprising the steps of:

obtaining a plate comprising one of pure aluminum and aluminum alloy; and subjecting said plate to electrochemical surface-roughing to form said pits in said surface by using an alternating current as an electrolytic power source for an acid electrolyte, said alternating current having a waveform with a frequency within a range of 80 to 120 Hz, and a ratio of an anode time $t_F$ to a period T ($t_F/T$) in a range of 0.25 to 0.20.

2. A process according to claim 1, wherein said aluminum support contains at least 0.3 wt% Mn.

3. A process according to claim 1, wherein said acid comprises a nitric acid.

4. A process according to claim 3, wherein said nitric acid is in an aqueous solution in an amount of 5 to 25 g/l and which solution is at a temperature of 20° to 60° C.

5. A process according to claim 4, wherein said amount of nitric acid is from 7.5 to 12.5 g/l, and said temperature is from 35° to 45° C.

6. A process according to claim 1, wherein prior to subjecting said plate to electrochemical surface-roughing, said plate is immersed in a caustic soda aqueous solution to perform alkali etching.

7. A process according to claim 6, wherein prior to subjecting said plate to electrochemical surface-roughing, and after immersing said plate in said caustic soda aqueous solution, said plate is immersed in an acid aqueous solution for performing neutralization and desmutting.

8. A process according to claim 1, wherein said waveform is one of a square wave, a trapezoidal wave, a sine wave, and a triangular wave.

9. A process according to claim 1, wherein said alternating current has an average current density of 10 to 50 $A/dm^2$.

10. A process according to claim 9, wherein said average current density is 15 to 30 $A/dm^2$.

11. A process according to claim 1, wherein after said plate is subjected to said electrochemical surface-roughing, said surface of said plate is coated with a photosensitive layer.

12. A process of claim 1, wherein said electrochemical surface-roughing is carried out for 10 to 120 seconds.

* * * * *